US010626780B2

(12) United States Patent
Konstanzer et al.

(10) Patent No.: US 10,626,780 B2
(45) Date of Patent: Apr. 21, 2020

(54) EXHAUST MANIFOLD FOR A MULTICYLINDER INTERNAL COMBUSTION ENGINE

(71) Applicant: Scania CV AB, Södertälje (SE)

(72) Inventors: Dennis Konstanzer, Spånga (SE); Kim Petersson, Södertälje (SE)

(73) Assignee: Scania CV AB, Södertälje (SE)

( * ) Notice: Subject to any disclaimer, the term of this patent is extended or adjusted under 35 U.S.C. 154(b) by 50 days.

(21) Appl. No.: 15/500,794

(22) PCT Filed: Aug. 21, 2015

(86) PCT No.: PCT/SE2015/050890

§ 371 (c)(1),
(2) Date: Jan. 31, 2017

(87) PCT Pub. No.: WO2016/036297

PCT Pub. Date: Mar. 10, 2016

(65) Prior Publication Data

US 2017/0218829 A1 Aug. 3, 2017

(30) Foreign Application Priority Data

Sep. 3, 2014 (SE) ..... 1451026

(51) Int. Cl.
*F01N 13/10* (2010.01)
*F02B 75/18* (2006.01)

(52) U.S. Cl.
CPC ..... *F01N 13/107* (2013.01); *F01N 13/10* (2013.01); *F02B 75/18* (2013.01); *F01N 2470/20* (2013.01); *F01N 2470/30* (2013.01)

(58) Field of Classification Search
CPC .... F01N 13/107; F01N 13/10; F01N 2470/20; F01N 2470/30; F02B 75/18;
(Continued)

(56) References Cited

U.S. PATENT DOCUMENTS 2,230,666 A 2/1941 Martin et al.
5,692,375 A 12/1997 Novak et al.
(Continued)

FOREIGN PATENT DOCUMENTS

DE 842873 C 7/1952
DE 19957979 A1 6/2001
(Continued)

OTHER PUBLICATIONS

International Search Report for PCT/SE2015/050890 dated Nov. 25, 2015.
(Continued)

*Primary Examiner* — Devon C Kramer
*Assistant Examiner* — Kelsey L Stanek
(74) *Attorney, Agent, or Firm* — Moore & Van Allen PLLC; W. Kevin Ransom

(57) ABSTRACT

The present invention relates to a manifold for receiving exhausts from a multi-cylindrical internal combustion engine. The internal combustion engine has such a firing order that the riser in the manifold receives exhausts from two cylinders during an overlapping stage, simultaneously via an inlet opening arranged upstream and from an inlet opening arranged downstream in the riser. The riser comprises a substantially constant cross sectional area, except in one area, which is located in a position in connection with the inlet opening arranged downstream of the two inlet openings, receiving exhausts simultaneously. Said area has a geometry facilitating receipt and flow of exhausts in the predetermined direction in the riser, on occasions when the two inlet openings receive exhausts simultaneously.

9 Claims, 2 Drawing Sheets

(58) Field of Classification Search
CPC .. F02B 2075/1832; F02B 27/00; F02B 27/04; Y02T 10/146
USPC ..... 60/323, 313, 274
See application file for complete search history.

(56) References Cited

U.S. PATENT DOCUMENTS

| | | | | |
|---|---|---|---|---|
| 5,860,278 | A | 1/1999 | Rodenkirch | |
| 8,650,867 | B2 | 2/2014 | Sloss | |
| 2014/0298799 | A1* | 10/2014 | Wu | F01N 13/10 60/602 |

FOREIGN PATENT DOCUMENTS

| | | | |
|---|---|---|---|
| EP | 0666411 | A1 | 8/1995 |
| FR | 2506837 | A1 | 12/1982 |
| JP | 10266844 | A * | 10/1998 |
| WO | 2013058700 | A1 | 4/2013 |

OTHER PUBLICATIONS

Written Opinion of the International Searching Authority for PCT/SE2015/050890 dated Nov. 24, 2015.
European Search Report for European Patent Application No. EP15837340 dated Jan. 4, 2018.
International Preliminary Report on Patentability for International Patent Application No. PCT/SE2015/050890 dated Mar. 7, 2017.
Korean Office Action for Korean Patent Application No. 10-2017-7007920 dated May 18, 2018.
Supplementary European Search Report for European Patent Application No. EP15837340 dated Dec. 19, 2017.

* cited by examiner

EXHAUST MANIFOLD FOR A MULTICYLINDER INTERNAL COMBUSTION ENGINE

CROSS-REFERENCE TO RELATED APPLICATION(S)

This application is a national stage application (filed under 35 § U.S.C. 371) of PCT/SE15/050890, filed Aug. 21, 2015 of the same title, which, in turn claims priority to Swedish Application No. 1451026-7, filed Sep. 3, 2014 of the same title; the contents of each of which are hereby incorporated by reference.

FIELD OF THE INVENTION

The present invention relates to a manifold for receiving exhausts from a multi-cylinder internal combustion engine.

BACKGROUND OF THE INVENTION

Exhausts from multi-cylindrical internal combustion engines are usually received in a manifold. A manifold comprises several branch lines that receive exhausts from the internal combustion engine's cylinders and a riser that receives the exhausts from the respective branch lines. Each cylinder generally comprises two exhaust valves. When the exhaust valves open, exhausts flow out into the connecting branch line with a high pressure, which is substantially related to the pressure of the exhausts in the cylinder right after the combustion stroke has ended. The pressure of the exhausts in the branch line during the remaining time, during which the exhaust valve is open, is lower and substantially related to the work of the piston in the cylinder when it presses the exhausts out into the branch line. The exhaust valves in the cylinders are normally open during the entire exhaust stroke, i.e. during a relatively large part of a four stroke engine's working cycle. The more cylinders in an internal combustion engine that are connected to a manifold, the harder it is to prevent the exhaust valves' opening times of several cylinders from overlapping at some time during the working cycle. In a manifold receiving exhausts from four cylinders, it is substantially impossible to create a firing order, such that the inlet opening times of the exhaust valves do not overlap each other at some point. On such occasions, exhausts are thus led out into the riser from several cylinders simultaneously.

It is not uncomplicated to lead exhausts out from several cylinders simultaneously into a riser. When a cylinder opens at the same time as exhausts are led out of another cylinder with a lower pressure, there is an obvious risk that the exhausts with the higher pressure penetrate down into the branch line ejecting exhausts with the lower pressure. Thus, the pressure in this branch line increases and the piston in this cylinder must work harder to eject the exhausts. The increased ejection work results in an increased fuel consumption of the internal combustion engine.

U.S. Pat. No. 5,860,278 shows a riser for receipt of exhausts from an internal combustion engine via a number of branch lines. The riser comprises constrictions in connection with all the outlets of the branch lines. Thus, the exhausts in the riser obtain an increased speed and a reduced static pressure in connection with the outlets in the riser. Accordingly, exhausts with a lower pressure may be ejected into the riser. However, the adaptation of the riser with constrictions at all outlets has the disadvantage of relatively large exhaust flow losses in the riser.

SUMMARY OF THE INVENTION

The objective of the present invention is to provide a manifold with a riser facilitating receipt of exhausts from two cylinders simultaneously, without significantly increasing the work of the internal combustion engine to eject the exhausts via the manifold.

This objective is achieved with a manifold for receiving exhausts from a multi-cylindrical internal combustion engine, wherein the manifold comprises at least three branch lines, each of which is adapted to receive exhausts from one of the internal combustion engine's cylinders, and a riser adapted to lead exhausts in a predetermined direction, and inlet openings in various positions located downstream in the riser in order to receive exhausts from the respective branch lines, wherein the internal combustion engine has such a firing order that the riser receives exhausts from two cylinders during an overlapping stage, simultaneously via an inlet opening arranged upstream and from an inlet opening arranged downstream in the riser. Since the firing order for the internal combustion engine's cylinders is known, the cylinders that eject exhausts simultaneously into the manifold are also known. The exhausts from the cylinders are led, via branch lines, into the riser's inlet openings, which are arranged in different positions arranged downstream in relation to each other. According to the invention, the cylinders with exhaust strokes overlapping each other and those inlet openings in the riser where exhausts simultaneously are received are determined in advance. Against the background of these facts, the riser is equipped with an area that has a geometry facilitating the receipt and flow of exhausts in the predetermined direction in the riser, on occasions when the two inlet openings receive exhausts simultaneously. This area is arranged in a position in connection with that inlet opening of the riser's two simultaneously exhaust receiving inlet openings, which is arranged downstream. In an area with such a geometry, inescapably larger flow losses are created than in other parts of the riser, which have a constant cross sectional area and advantageously a substantially straight extension. Since the riser only comprises an area with such a different geometry, the flow resistance to the exhausts in the manifold becomes significantly smaller than if the riser were equipped with several such areas with differing geometries, and in connection with all the inlet openings in the riser.

According to one embodiment of the present invention, said area is arranged in a position immediately upstream of the inlet opening arranged downstream. Thus, the exhausts from the inlet opening arranged upstream may be accelerated to a suitable speed, before they come into contact with the exhausts led into the riser via the inlet opening arranged downstream.

According to one embodiment of the present invention, the flow passage in said area has a successively reduced cross sectional area at an outlet end in relation to at an inlet end of said area. The cross sectional area in the area may have a reduction in the range of 10-40%. Through such a reduction of the cross sectional area, the speed of the exhausts from the inlet opening arranged upstream may be substantially increased, before they come into contact with the exhausts that are led into the riser via the inlet opening arranged downstream, without the flow resistance of the exhausts becoming too great when they pass through said area.

According to another preferred embodiment of the present invention, the riser comprises a wall construction that comprises an internal wall surface defining the flow passage through said area. In this case, the riser's wall construction may be given a shape, such that the internal wall surface defines the flow passage's geometry in said area. Alternatively, the riser may be equipped with internal separate flow elements, attached inside the riser, which are shaped in such a manner that they create the geometry of the flow passage in said area.

According to another preferred embodiment of the present invention, the riser's wall construction has an internal wall side, which faces the internal combustion engine comprising said inlet openings and an external wall side, which faces away from the internal combustion engine. In this case, the inlet openings may be arranged in a row on the internal wall side.

According to another preferred embodiment of the present invention, the internal combustion engine has such a firing order that the riser already receives an existing exhaust flow, via the inlet opening arranged downstream, at a time when an initial exhaust flow is received in the riser via the inlet opening arranged upstream. When an exhaust valve in a cylinder opens, an initial exhaust flow with a high pressure is obtained, following which the pressure drops during a remaining part of the exhaust stroke. In this case, exhausts with the higher pressure are led into the exhaust conduit via the inlet opening arranged upstream in the riser. The riser's internal wall side may have an angle in said area in relation to the primary flow direction of the exhausts in other parts of the riser, which angle defines the geometry of the flow passage in the area. When the exhaust flow reaches this area, it obtains an increased speed and a reduced static pressure. The reduced static pressure means that the exhausts with the lower pressure may be led into the riser via the inlet opening arranged downstream.

Said angle in the area also results in the exhausts with the higher pressure flowing at a distance from the inlet opening arranged downstream. Accordingly, space, where they may flow into the riser, is created for the exhausts with the lower pressure.

According to another preferred embodiment of the present invention, the branch line leading exhausts to the riser, via the inlet opening arranged downstream, comprises an internal wall surface with a tapered portion, which gives the inlet opening a successively expanding cross sectional area. With the help of such a tapered portion, an exhaust vortex is created in the inlet opening arranged downstream. Such an exhaust vortex efficiently prevents the exhausts in the riser from being led down into the branch line via the inlet opening.

According to one preferred embodiment of the present invention, the internal combustion engine has such a firing order that the riser already receives an existing exhaust flow, via the inlet opening arranged upstream, at a time when an initial exhaust flow is received in the riser via the inlet opening arranged downstream. In this case, exhausts with the lower pressure are led into the exhaust conduit via the inlet opening arranged upstream in the riser. The riser's second wall side may have a wedge-shaped portion in said area, comprising a first wall surface with a gradient, such that it reduces the cross sectional area of the flow passage in the riser, and a subsequent second wall surface with a gradient, such that it expands the cross sectional area of the flow passage in the riser, wherein the wedge-shaped portion is arranged in such a position that the exhaust flow, which has been led into the riser via the inlet opening arranged downstream, hits the second wall surface. The first wall surface of the wedge-shaped portion directs the exhaust flow with the lower pressure toward the exhausts with the higher pressure, which flow out from the inlet opening arranged downstream. The second wall surface of the wedge-shaped portion has a gradient, such that it leads the exhausts with the higher pressure in the intended flow direction in the riser. The second wall surface may have a substantially parallel extension with the exhaust flow, which flows out of the inlet opening arranged downstream. The wedge-shaped portion substantially prevents any part of the exhausts with the higher pressure from being led into an incorrect counterflow direction in the riser.

According to one preferred embodiment of the present invention, the wedge-shaped portion has a height, which is in the range of 3-10% of the diameter of the flow passage in the riser. The wedge-shaped portion may have a height of approximately 5% of the diameter of the flow passage. Thus, the wedge-shaped portion protrudes a relatively small distance into the second riser. The flow losses in the area are accordingly relatively minor. The first wall surface advantageously has a smaller angle in relation to the primary flow direction in the riser than has the second wall surface. The first wall surface may have an angle of approximately 5°, and the second wall surface may have an angle of approximately 1° in relation to the flow direction in the riser 4*b*. It is thus sufficient for the exhausts with the higher pressure to hit a second wall surface with a small enough angle in relation to the intended flow direction in the riser, to prevent that exhausts with the higher pressure are led into an incorrect direction in the riser.

According to one preferred embodiment of the present invention, the manifold is made of a cast material. Said areas located in the risers have geometries, which may be created relatively easily in a casting process.

The invention also relates to an internal combustion engine comprising a manifold as described herein. The internal combustion engine comprises at least three cylinders. A internal combustion engine with six or more cylinders may comprise a first manifold on a first side in order to receive exhausts from three or more cylinders, and a second manifold, which is arranged on an opposite side in order to receive exhausts from a remaining number of cylinders. Such an internal combustion engine may be a V8-engine.

BRIEF DESCRIPTION OF THE DRAWING

Below is a description, as an example, of preferred embodiments of the invention with reference to the enclosed drawings, on which.

DETAILED DESCRIPTION OF THE INVENTION

Figure 1:
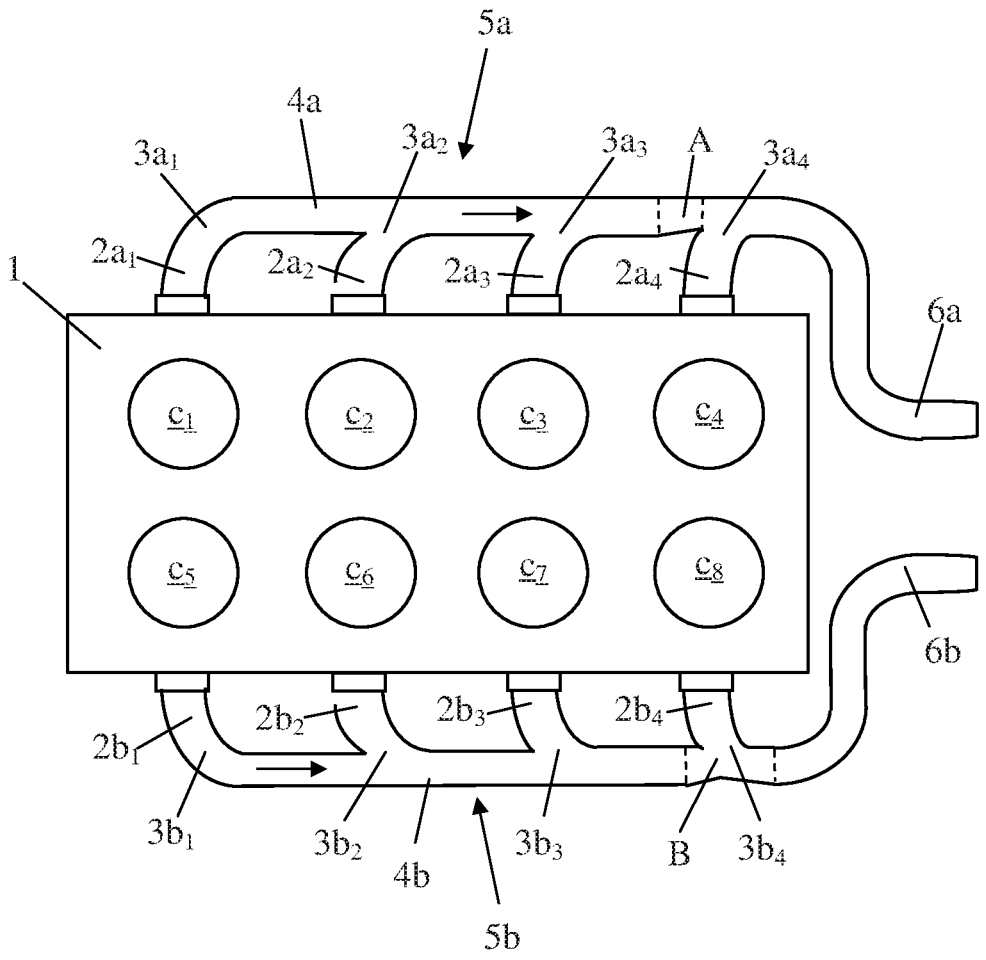
FIG. 1 shows a first manifold and a second manifold, each of which receives exhausts from four cylinders in an internal combustion engine.

FIG. 1 shows an internal combustion engine 1 with eight cylinders $c_{1-8}$. The internal combustion engine 1 in this case is a V8 engine. Each one of the cylinders $c_{1-8}$ is connected with a branch line $\mathbf{2}a_{1-4}$, $\mathbf{2}b_{1-4}$ that ejects exhausts from the respective cylinders $c_{1-8}$. The exhausts from the cylinders $c_{1-4}$ on one of the sides of the internal combustion engine 1 are led, via branch lines $2a_{1-4}$ and inlet openings $3a_{1-4}$, to a first riser 4*a*. The exhausts from the cylinders $c_{5-8}$ on the other side of the internal combustion engine 1 are led, via branch lines $2b_{1-4}$ and inlet openings $3b_{1-4}$, to a second riser 4*b*. The branch lines $2a_{1-4}$ and the riser 4*a* define a first manifold 5*a*. The first manifold 5*a* transitions into a first exhaust conduit 6*a*, which leads the exhausts to a non-displayed turbo charger. The manifolds $2b_{1-4}$ and the riser 4*b* define a second manifold 5*b*. The second manifold 5*b* transitions into a second exhaust conduit 6*b*, which leads the exhausts to a non-displayed turbo charger.

The exhaust flow from each one of the cylinders $c_{1-8}$ is controlled by at least one exhaust valve, which is arranged in such a manner that it may be shifted between a closed state and an open state. Usually, each one of the cylinders $c_{1-8}$ is equipped with two exhaust valves to facilitate the ejection of the exhausts. When the exhaust valves open, initially an exhaust flow with a high pressure is ejected from the cylinders $c_{1-8}$, via the respective branch lines $2a_{1-4}$, $2b_{1-4}$ and the inlet opening $3a_{1-4}$, $3b_{1-4}$ to the risers 4*a*, 4*b*. For the remainder of the duration when the cylinders $c_{1-8}$ are open, the exhausts are ejected with a lower pressure to the risers 4*a*, 4*b*. This lower pressure is substantially defined by the movements of the piston in the cylinders $c_{1-8}$, when it presses the exhausts out into the respective branch lines $2a_{1-4}$, $2b_{1-4}$ Since each of the manifold's risers 4*a*, 4*b* receives exhausts from four cylinders cats, it is substantially impossible to avoid that the opening times of the exhaust valves of at least two cylinders $c_{1-8}$ overlap. The risers 4*a*, 4*b* will thus receive exhausts from more than one cylinder $c_{1-8}$ during a certain part of the internal combustion engine's working cycle.

The firing order for the internal combustion engine's cylinders $c_{1-8}$ is in this case $c_1$, $c_5$, $c_4$, $c_2$, $c_6$, $c_3$, $c_7$, $c_8$. With such a firing order the exhaust valves of the cylinders $c_2$, $c_4$ will be open simultaneously. The exhaust valve of the cylinder $c_2$ opens when the exhaust valve of the cylinder $c_4$ is already open. When this happens, exhausts with a high pressure are ejected from the branch line $2a_2$, while exhausts with a lower pressure are ejected from the branch line $2a_4$. In a conventional manifold, in this case a part of the exhausts flowing through the first riser 4*a* with a high pressure will be led into the branch line $2a_4$. Accordingly, the pressure rises in the branch line $2a_4$, where exhausts are ejected with a lower pressure. Accordingly, the piston in the cylinder $c_4$ must work harder to pump out the exhausts. With the above mentioned firing order the opening times of the exhaust valves of the cylinders $c_7$, $c_8$ will also overlap. In this case, the exhaust valve of the cylinder $c_8$ opens, when the exhaust valve of the cylinder $c_7$ is already open. When this happens, exhausts with a high pressure are ejected from the branch line $2b_4$, while exhausts with a lower pressure are ejected from the branch line $2b_3$. In a conventional manifold a part of the exhausts that flows through the manifold $2b_4$ with a high pressure will be led in the wrong direction in the second riser 4*b*. Thus, the pressure in the branch line $2b_3$ rises when exhausts are ejected with a lower pressure. Accordingly, the piston in the cylinder $c_7$ must work harder to pump out the exhausts.

Figure 2:
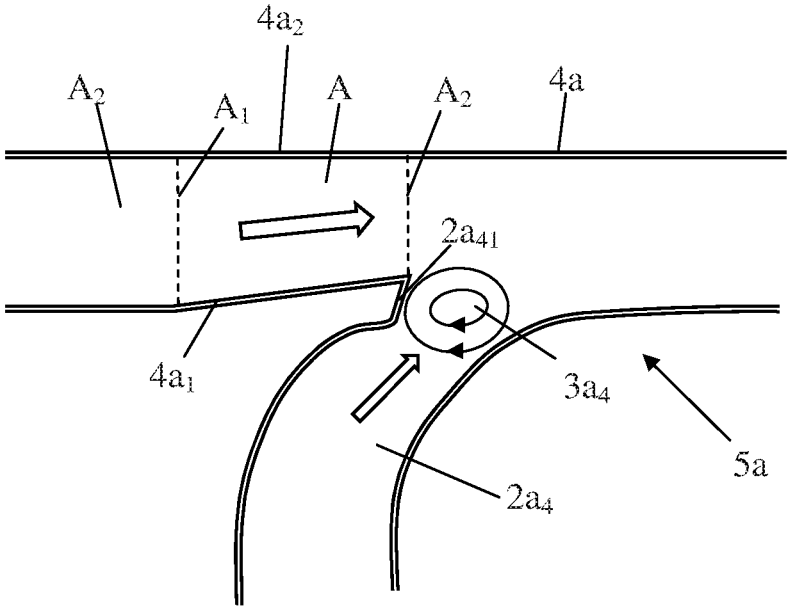
FIG. 2 shows a cross sectional view of the first manifold in an area A-A in FIG. 1.

FIG. 2 shows a cross sectional view through the connecting area, where the branch line $2a_4$ ejects exhausts into the first riser 4*a*. The first riser 4*a* has an inner wall side $4a_1$ located on the same side as the branch lines $2a_{1-4}$ and the inlet openings $3a_{1-4}$. The first riser 4*a* has an external wall side $4a_2$ located on an opposite side of the branch lines $2a_{1-4}$ and the inlet openings $3a_{1-4}$. The first riser 4*a* has an area A, with an extension from an inlet $A_1$ to an outlet $A_2$. The outlet $A_2$ is located in connection with the inlet opening $3a_4$, where the riser 4*a* receives exhausts from the branch line $2a_4$. The first riser 4*a* comprises a flow passage with a substantially constant cross sectional area upstream and downstream of the area A, with respect to the intended flow direction of the exhausts in the riser 4*a*. In the area A, the inner wall side $4a_1$ of the first riser 4*a* has an angle in relation to the primary flow direction of the exhaust flow in the first riser 4*a*. Upstream and downstream of the first area A, the first riser's 4*a* inner wall side $4a_1$ has a linear extension, which is substantially parallel with the primary flow direction of the exhaust flow in the first riser 4*a*. The second riser's 4*a* external wall side $4a_2$ has a substantially linear extension in the entire riser 4*a*. The first riser's inner wall side $4a_1$ has a gradient, such that the distance between the inner wall side $4a_1$ and the outer wall side $4a_2$ subsides continuously from the inlet $A_1$ to the outlet $A_2$ in the first area A. In this case the distance subsides linearly. Thus, a successively narrowing cross sectional area is created for the exhaust flow in the first area A. The branch line $2a_4$, which leads exhausts to the riser 4*a* via the inlet opening $3a_4$, comprises a wall surface with a tapered portion $2a_{41}$, providing the inlet opening $3a_4$ with an expanding cross sectional area. With such a tapered portion, the inlet opening $3a_4$ obtains a funnel-like shape. In an inlet opening $3a_4$ with such a shape, an exhaust vortex is formed. It may be noted that the inward bend in the area A has been exaggerated in the figures, in order to more clearly exemplify the invention.

On occasions when the exhaust valves in the cylinder $c_4$ are open and when the exhaust valves in the cylinder $c_2$ open, a powerful initial exhaust flow is provided from the cylinder $c_2$, via the second branch line $2a_2$ and the inlet opening $3a_2$, to the riser 4*a*. When this exhaust flow reaches the area A, the exhaust flow provides an acceleration through the subsiding cross sectional area. The first riser 4*a* may have a reduced cross sectional area in the range of 10-40%, for example 30%, at the outlet $A_2$ in relation to at the inlet $A_1$ of the area A. Accordingly, the exhausts that leave the first area A obtain a reduced static pressure in connection with the inlet opening $3a_4$. Accordingly, the propensity of the exhaust flow leaving the area A to penetrate into the branch line $2a_4$ is counteracted. The inner wall side $4a_1$ thus has an angle in relation to the exhaust flow's primary flow direction in the first area A. The inner wall side $4a_1$ has an angle, such that the exhaust flow obtains a relatively soft directional change in connection with the first wall side $4a_1$ in the area A. The inner wall side $4a_1$ reduces the exhaust flow in the area A on the side where the first riser 4*a* receives exhausts via the inlet opening $3a_4$. The directional change, which the exhaust flow obtains in the first area A, in connection with the inner wall side $4a_1$, means that the exhaust flow is led in a direction partly away from the inlet opening $3a_4$. This makes it even more difficult for the exhausts leaving the area A to penetrate into the branch line $2a_4$. At the same time, an area is created in the riser 4*a* into which the exhausts with the lower pressure, leaving the branch line $2a_4$, may be led. The exhaust vortex formed in the funnel shaped area of the branch line $2a_4$ in connection with the inlet opening $3a_4$ also makes it difficult for the exhausts leaving the area A to penetrate into the branch line $2a_4$.

Figure 3:
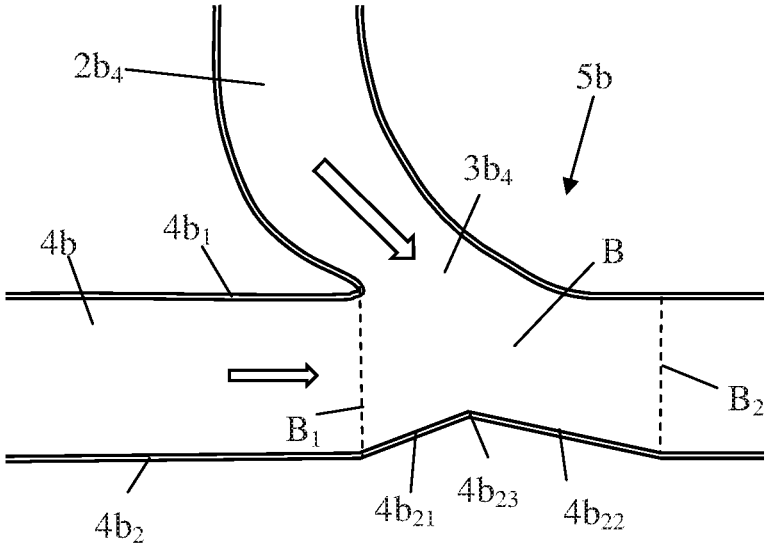
FIG. 3 shows a cross sectional view of the second manifold in an area B-B in FIG. 1.

FIG. 3 shows a cross sectional view through the connecting area, where the second riser 4*b* receives exhausts from the branch line $2b_4$ via the inlet opening $3b_4$. The second riser 4*b* has an inner wall side $4b_1$, located on the same side as the branch line $2b_4$ and the inlet opening $3b_4$. The second riser 4*b* has an outer wall side $4b_2$, located on an opposite side of the branch line $2b_4$ and the inlet opening $3b_4$. The second riser 4*b* has an area B, which extends from an inlet $B_1$ to an outlet $B_2$. The first riser 4*b* comprises a flow passage with a substantially constant cross sectional area upstream and downstream of the area B, with respect to the intended flow direction of the exhausts in the riser 4*b*.

The second riser's 4*b* outer wall side $4b_2$ has a wedge-shaped portion in the second area B, comprising a first wall surface $4b_{21}$ with a gradient, such that it reduces the cross sectional area of the flow passage in the riser 4*b*, and a subsequent second wall surface $4b_{22}$ with a gradient, such that it expands the flow passage's cross sectional area in the riser 4*b*. It may be noted that the inward bend in the area B has been exaggerated in the figures, in order to exemplify the invention more clearly The first wall surface $4b_{21}$ and the second wall surface $4b_{22}$ have a breaking point $4b_{23}$. The wedge-shaped portion is arranged in such a position that the exhaust flow led into the riser 4*b*, via the inlet opening $3b_4$ arranged downstream, only hits the second wall surface $4b_{22}$. The entire exhaust flow from the branch line $2b_4$ thus hits to the right of the breaking point $4b_{23}$. The exhaust flow from the branch line $2b_4$ should, however, hit as close to the breaking point $4b_{23}$ as possible.

The wedge-shaped portion has a height in the range of 3-10% of the flow passage's diameter in the riser 4*b*. The wedge-shaped portion may have a height of approximately 5% of the diameter of the flow passage. Thus, the wedge-shaped portion protrudes a relatively small distance into the second riser 4*b*. The flow losses in the area are accordingly relatively minor. The first wall surface $4b_{21}$ has an angle of approximately 1° in relation to the primary flow direction in the riser, and the second wall surface $4b_{22}$ has an angle of approximately 5° in relation to the primary flow direction in the riser 4*b*. It is thus sufficient that the second wall surface has a sufficiently small angle to direct the exhausts are leaving the branch line $2b_4$ and hitting the surface in a desired direction in the riser 4*b*. The second riser's 4*b* outer wall side $4b_2$ has, upstream and downstream of the area B, a linear extension that is parallel with the primary flow direction of the exhaust flow in the second riser 4*b*. The second riser's 4*b* inner wall side $4b_1$ has a substantially linear extension.

On occasions when the exhaust valves of the cylinder $c_7$ are open and when the exhaust valves of the cylinder $c_8$ open, a powerful initial exhaust flow is provided from the cylinder $c_8$, via the branch line $2b_4$ and the inlet opening $3b_4$, to the second riser 4*b*. At the same time, exhausts with a lower pressure are led from the cylinder $c_7$, via the branch line $2b_3$ and the inlet opening $3b_3$, to the second riser 4*b*. The first wall surface $4b_{21}$ of the wedge-shaped portion directs the exhaust flow with the lower pressure toward the exhausts with the higher pressure, which flow out of the inlet opening $3b_4$ arranged downstream. The second wall surface $4b_{22}$ of the wedge-shaped portion has a gradient, such that it leads the exhausts with the higher pressure in the intended flow direction in the riser 4*b*. The wedge-shaped portion prevents substantially any part of the exhausts with the higher pressure from being led into an incorrect counterflow direction in the riser 4*b*. Said areas A, B which are located in the risers 4*a*, 4*b*, have geometries which may be created in a casting process relatively easily. The manifolds 5*a*, 5*b* are thus advantageously made in a casting process.

The internal combustion engine 1 thus has two manifolds 5*a*, 5*b*, which receive exhausts from two different sides of the internal combustion engine 1. With knowledge about the internal combustion engine's firing order both the manifolds 5*a*, 5*b* have been equipped with areas A, B in connection with the inlet opening $2a_4$, $2b_4$ arranged downstream, for supply of exhausts from two cylinders $c_2$, $c_4$, $c_7$, $c_8$ having overlapping opening times of the exhaust valves. The areas A, B have sections with different geometries, in order to receive and lead the exhausts in a predetermined direction in the respective risers 4*a*, 4*b* on the different sides of the internal combustion engine 1, depending on if the inlet opening arranged downstream $2a_4$, $2b_4$ supplies exhausts with the higher pressure or the lower pressure.

The invention is in no way limited to the embodiment described above, but may be varied freely within the framework of the claims. The manifold may receive exhausts from a varying number of cylinders in an internal combustion engine.

The invention claimed is:

1. A manifold for receiving exhaust from an internal combustion engine comprising a plurality of cylinders, wherein the manifold comprises:

at least first and second branch lines, each of which is adapted to receive exhaust from a respective one of the cylinders of the internal combustion engine, wherein the first and second branch lines are positioned in the manifold, such that the first and second branch lines receive exhaust simultaneously from their respective cylinders during an overlapping stage of operation of the combustion engine, and wherein the second branch line is located downstream of the first branch line;

a first inlet opening configured to receive exhaust from the first branch line and a second inlet opening configured to receive exhaust from the second branch line; and a riser connected to the first and second inlet openings comprising a flow passage configured to lead exhaust from the first and second inlet openings, wherein the flow passage has an area located in a position in connection with said second inlet opening, where said second inlet opening is arranged to receive exhaust from the second branch line, wherein said area of said flow passage is located in a position immediately upstream of said second inlet opening, wherein said area of said flow passage begins at a surface of the flow passage and extends with a successively subsiding cross-sectional area from an inlet up to an outlet of said flow passage, wherein an external wall side of said flow passage extends parallel to a flow of exhaust in the riser and an inner wall side of said flow passage located opposite the external wall side extends at an inward angle toward the external wall side to facilitate a receipt and flow of exhaust in a predetermined direction in the riser in a direction downstream relative to the first branch line, when the first and second inlet openings, respectively associated with the first and second branch lines receive exhaust simultaneously from the respective cylinders.

2. The manifold according to claim 1, wherein the riser comprises an internal wall surface, which defines the flow passage through said area.

3. The manifold according to claim 1, wherein the inlet opening associated with the second branch line receives an exhaust flow from its respective cylinder prior to the inlet opening associated with the first branch line receiving an exhaust flow from its respective cylinder.

4. The manifold according to claim 1, wherein the second branch line, comprises an internal wall surface with a tapered portion giving the second inlet opening an expanding cross-sectional area.

5. A manifold for receiving exhaust from an internal combustion engine comprising a plurality of cylinders, wherein the manifold comprises:

at least first and second branch lines, each of which is adapted to receive exhausts from one of the internal combustion engine's cylinders;

a riser adapted to lead exhausts in a predetermined direction; and a first inlet opening configured to receive exhausts from the first branch line and a second inlet opening configured to receive exhaust from the second branch line, wherein the internal combustion engine has such a firing order that the riser already receives an existing exhaust flow, via the first inlet opening arranged upstream, at a time when an initial exhaust flow is received in the riser via the second inlet opening arranged downstream of the first inlet opening, wherein the riser comprises:

a flow passage with a substantially constant cross-sectional area, except in one area located in a position in connection with the second inlet opening, wherein the flow passage of said riser comprises:

a first wall side, which comprises the second inlet opening; and a second opposite wall side arranged on an opposite side of the second inlet opening, and wherein the riser's second opposite wall side has, in said area, a wedge-shaped portion comprising a first wall surface, with such a gradient that it reduces the flow passage's cross sectional area in the riser and a subsequent, and a second wall surface with such a gradient that it expands the flow passage's cross sectional area in the riser, to facilitate a receipt and a flow of exhausts in the predetermined direction in the riser on occasions when the first and second inlet openings receive exhausts simultaneously, and wherein the wedge-shaped portion is arranged in such a position that the exhaust flow led into the riser, via the second inlet opening, contacts the second wall surface.

6. The manifold according to claim 5, wherein the wedge-shaped portion has a height in a range of 3-10% of a diameter of the flow passage in the riser.

7. The manifold according to claim 5, wherein the first wall surface has a greater angle in relation to the primary flow direction in the riser than has the second wall surface.

8. An internal combustion engine comprising at least one manifold for receiving exhaust from an internal combustion engine comprising a plurality of cylinders, wherein the manifold comprises:

at least first and second branch lines, each of which is adapted to receive exhaust from a respective one of the cylinders of the internal combustion engine, wherein the first and second branch lines are positioned in the manifold, such that the first and second branch lines receive exhaust simultaneously from their respective cylinders during an overlapping stage of operation of the combustion engine, and wherein the second branch line is located downstream of the first branch line;

a first inlet opening configured to receive exhaust from the first branch line and a second inlet opening configured to receive exhaust from the second branch line; and a riser connected to the first and second inlet openings comprising a flow passage configured to lead exhaust from the first and second inlet openings, wherein the flow passage has an area located in a position in connection with said second inlet opening, where said second inlet opening is arranged to receive exhaust from the second branch line, wherein said area of said flow passage is located in a position immediately upstream of said second inlet opening, wherein said area of said flow passage begins at a surface of the flow passage and extends with a successively subsiding cross-sectional area from an inlet up to an outlet of said flow passage, wherein an external wall side of said flow passage extends parallel to a flow of exhaust in the riser and an inner wall side of said flow passage located opposite the external wall side extends at an inward angle toward the external wall side to facilitate a receipt and flow of exhaust in a predetermined direction in the riser in a direction downstream relative to the first branch line, when the first and second inlet openings, respectively associated with the first and second branch lines receive exhaust simultaneously from the respective cylinders.

9. An internal combustion engine comprising at least one manifold for receiving exhaust from an internal combustion engine comprising a plurality of cylinders, wherein the manifold comprises:

at least first and second branch lines, each of which is adapted to receive exhausts from one of the internal combustion engine's cylinders;

a riser adapted to lead exhausts in a predetermined direction; and a first inlet opening configured to receive exhausts from the first branch line and a second inlet opening configured to receive exhaust from the second branch line, wherein the internal combustion engine has such a firing order that the riser already receives an existing exhaust flow, via the first inlet opening arranged upstream, at a time when an initial exhaust flow is received in the riser via the second inlet opening arranged downstream of the first inlet opening, wherein the riser comprises:

a flow passage with a substantially constant cross-sectional area, except in one area located in a position in connection with the second inlet opening, wherein the flow passage of said riser comprises:

a first wall side, which comprises the second inlet opening; and a second opposite wall side arranged on an opposite side of the second inlet opening, and wherein the riser's second opposite wall side has, in said area, a wedge-shaped portion comprising a first wall surface, with such a gradient that it reduces the flow passage's cross sectional area in the riser and a subsequent, and a second wall surface with such a gradient that it expands the flow passage's cross sectional area in the riser, to facilitate a receipt and a flow of exhausts in the predetermined direction in the riser on occasions when the first and second inlet openings receive exhausts simultaneously, and wherein the wedge-shaped portion is arranged in such a position that the exhaust flow led into the riser, via the second inlet opening, contacts the second wall surface.

* * * * *